US009630301B2

(12) United States Patent
Ryans

(10) Patent No.: US 9,630,301 B2
(45) Date of Patent: Apr. 25, 2017

(54) COMPACT GAS CYLINDER VALVE RATCHET DRIVER TOOL

(71) Applicant: Lawrence Ryans, Davie, FL (US)

(72) Inventor: Lawrence Ryans, Davie, FL (US)

( * ) Notice: Subject to any disclaimer, the term of this patent is extended or adjusted under 35 U.S.C. 154(b) by 162 days.

(21) Appl. No.: 14/308,819

(22) Filed: Jun. 19, 2014

(65) Prior Publication Data

US 2015/0047473 A1 Feb. 19, 2015

Related U.S. Application Data

(60) Provisional application No. 61/865,813, filed on Aug. 14, 2013.

(51) Int. Cl.

| | |
|---|---|
| ***B25B 13/06*** | (2006.01) |
| ***B25B 13/48*** | (2006.01) |
| ***B25B 13/46*** | (2006.01) |
| ***B25B 15/04*** | (2006.01) |
| ***B25B 23/00*** | (2006.01) |

(52) U.S. Cl.

CPC ..... *B25B 13/48* (2013.01); *B25B 13/06* (2013.01); *B25B 13/065* (2013.01); *B25B 13/463* (2013.01); *B25B 15/04* (2013.01); *B25B 23/0042* (2013.01)

(58) Field of Classification Search

CPC ..... B25B 13/48; B25B 23/0042; B25B 13/06; B25B 13/065; B25B 15/04; B25B 13/463

USPC ..... 81/60–63.2

See application file for complete search history.

(56) References Cited

U.S. PATENT DOCUMENTS

| | | | | | |
|---|---|---|---|---|---|
| 593,157 | A | * | 11/1897 | Furbish | B25B 13/463 192/43.1 |
| 2,601,799 | A | * | 7/1952 | Garwood | B25B 13/466 81/480 |
| 3,958,469 | A | * | 5/1976 | Meese | B25B 13/466 81/58.3 |
| 4,696,208 | A | * | 9/1987 | Lay | B25B 13/462 81/58 |
| 5,379,873 | A | * | 1/1995 | Shiao | B25B 13/463 192/43 |
| 5,573,357 | A | * | 11/1996 | Mirles | B23G 1/261 408/1 R |
| 5,749,272 | A | * | 5/1998 | Phan | B25B 13/463 192/43.1 |

(Continued)

*Primary Examiner* — Larry E Waggle, Jr.
*Assistant Examiner* — Danny Hong
(74) *Attorney, Agent, or Firm* — Leslie A. Thompson; Leslie A. Thompson & Asso

(57) ABSTRACT

Disclosed is a gas cylinder ratchet driver tool that is specifically suited for opening and closing valve posts of gas cylinders. The tool comprises an outer handle body for one-handed use and an external ratchet switching actuator. Within the handle body is an internal housing that supports a rotatable socket therein. The socket comprises an elongated length with a lower working end adapted to engage a gas cylinder valve post and a ratchet gear upper end. A first and second wedge plate supported by the housing and acted upon by the actuator controls the ratchet direction by bearing against the ratchet gear, determining ratchet direction or ratchet lock. A flat spring beneath the actuator manipulates the wedge plates against the ratchet gear to control the ratchet direction. The socket working end comprises two flat portions to facilitate placement of the socket onto a gas cylinder valve post in emergency situations.

12 Claims, 4 Drawing Sheets

(56) References Cited

U.S. PATENT DOCUMENTS

| | | | | |
|---|---|---|---|---|
| 5,806,381 | A * | 9/1998 | Lin | B25B 15/04 81/451 |
| 6,393,949 | B1 * | 5/2002 | Ho | B25G 1/063 192/43.1 |
| 6,435,061 | B1 * | 8/2002 | Ho | B25B 15/04 81/58.4 |
| 7,398,710 | B1 * | 7/2008 | Ho | B25G 1/063 192/43.2 |
| 7,430,945 | B2 * | 10/2008 | Gauthier | B25B 13/463 81/467 |
| 8,122,791 | B2 * | 2/2012 | Klomp | B25B 13/463 192/43.2 |

* cited by examiner

COMPACT GAS CYLINDER VALVE RATCHET DRIVER TOOL

CROSS REFERENCE TO RELATED APPLICATION

This application claims the benefit of U.S. Provisional Application No. 61/865,813 filed on Aug. 14, 2013. The above identified patent application is herein incorporated by reference in its entirety to provide continuity of disclosure.

BACKGROUND OF THE INVENTION

Field of the Invention

The present invention relates to compact ratchet tools and devices for rapidly opening or closing compressed gas cylinder valves otherwise requiring a wrench tool. More specifically, the present invention relates to a compact, palm-driven ratchet tool that facilitates driving a gas cylinder valve post using a ratchet action with a reduced tool swing path, while attachment of the tool to the valve post is possible in low light and emergency situations.

Gas cylinders are used in many fields and industries, and provide a common means of compressed gas transport and storage using cylindrical vessels. The vessels store a gaseous compound in a compressed state for subsequent use. These uses include applications in various manufacturing and production environments, research environments, emergency services uses, and in the medical field. Most of these vessels are delivered through a specific valve that provides access to the compressed contents, wherein the valve may or may not be openable without a tool. For most applications, the end user will deploy a crescent wrench, cylinder key, or opened end box wrench to open and close the valve post. Valve posts themselves are well understood in the field of compressed gas and gas cylinder tanks. However, a need is present for a tool that can more readily open or close the valve posts of these devices and access the gas contents more rapidly, particularly in emergency situations.

Using a crescent wrench or open end box wrench tool to open a gas cylinder valve requires user coordination, patience, and above all that the vessel is clearly visible to the user. The user first has to locate the valve post, secure the wrench thereto, and rotate the tool to open or close the valve. Properly seating the working end of a crescent wrench or an open end box wrench to a gas cylinder post is challenging even under the most optimum of circumstances. However, in high pressure situations involving time sensitive applications or involving environments with less than optimal visibility, properly seating the wrench and accessing the gas can be a cumbersome task.

The present invention relates to a hand tool that facilitates seating and applying torque to a standard gas cylinder straight post, wherein the tool overcomes the common drawbacks in the art associated with locating and efficiency applying torque to the vale post. The present invention aims to replace the use of standard hand tools that are not specific to gas cylinder valve application, such as crescent wrenches and the like, for a tool that is more compact, more efficient, and one that is readily deployable and specifically suited for use with gas cylinder valves. The present invention is contemplated for emergency series and responders in dangerous environments, in the medical field where time is a factor, and also in manufacturing or production environments where efficiency is valued.

The present invention is a ratchet driver tool specifically adapted for engaging the valve post of most common gas cylinders, wherein attachment of the tool and application of torque thereto does not require the user to visualize the valve post or to fiddle with a tool that requires multiple hands. The present invention comprises a compact, one-handed tool having a singular socket specifically for gas cylinder valve posts and a tool handle formed to be palm-held. Within the tool body is a compact ratchet mechanism that can be switched with a slidable actuator. The tool is adapted to provide emergency responders, healthcare professionals, and others with a tool that can be rapidly deployed to open or close the valve post of a gas cylinder, wherein speed, efficiency, and ease of operation are facilitated.

Description of the Prior Art

Devices have been disclosed in the prior art that relate to driver tools and gas cylinder keys. These include devices that have been patented and published in patent application publications, and generally relate to simple hand tools that do not provide a ratchet function or are not specifically suited for the purpose of opening and closing a gas cylinder valve under all conditions contemplated by the present invention. The following is a list of devices deemed most relevant to the present disclosure, which are herein described for the purposes of highlighting and differentiating the unique aspects of the present invention, and further highlighting the drawbacks existing in the prior art.

The devices of the prior art relate largely to simple hand tools that engage the valve post of a gas cylinder and provide leverage for opening and closing thereof. These devices are typically flat instruments that include a notch or similar aperture for secure to the valve post and providing an elongated tool body to apply torque thereto. These devices are well known in the field of gas tanks and provide a convenient tool that both facilitates valve operation while consuming very little space on one's person or in a tool box.

Devices that exemplify these tools include U.S. Design Pat. No. 333,243 to Brown, U.S. Design Pat. No. 267,392 to Hildebrandt, and U.S. Design Pat. No. 301,010 to Renna. These devices are largely flat structures with a tool handle end and a working end with a key or slot adapted for engaging a gas cylinder valve post. A more complex valve tool of this type is disclosed in U.S. Pat. No. 8,087,639 to Knapp, wherein a gas cylinder tank key is provided with a socketed central portion, a slotted first end, and a multi-apertured second end, wherein the tool is adapted to engage a gas cylinder in a plurality of fashions and facilitate an increase in leverage during use.

These devices, while fulfilling a need in the art for opening and securely closing the valve posts of different gas cylinders, fail to provide a ratcheting means to rapidly open and close gas cylinders. These devices are also not compact tools, and comprise elongated tool bodies with a large swing radius. The present invention relates to a ratchet type driver tool that is specifically designed to engage a gas cylinder valve post using a compact, palm driving tool that is deployable in all conditions for efficient opening and closing of various gas cylinders in the field.

Other devices in the art relate to standard ratchet wrenches and socket wrenches. One device in the art that provides a compact ratchet driver is U.S. Pat. No. 5,461,950 to Iwinski, which discloses an oblong tool housing a ratchet mechanism therein and a centrally located shaft portion adapted to be driven by the ratchet mechanism and support a driver tool therein. A ratchet detent mechanism is located within one side of the oblong housing, while an open shaft extends centrally therethrough. The user rotates the housing to apply torque in one of two directions, according to the ratchet mechanism locking direction. This compact device, while providing a handheld ratchet assembly for driving and applying torque, does not contemplate a gas cylinder specific tool having a dedicated valve post driver, nor does this prior art device disclose the construction or arrangement of the ratchet assembly of the present invention, which is centrally located and does not provide a central open shaft. The present invention utilizes a simpler ratchet mechanism to facilitate its compact construction and efficient operation, wherein ratchet direction is controlled by a simple flat spring and a pair of wedge plates acting on a pinion gear of the socket proximal end within the tool body.

It is submitted that the present invention is substantially divergent in design elements from the prior art, and consequently it is clear that there is a need in the art for an improvement to existing gas cylinder valve driver tools. In this regard the instant invention substantially fulfills these needs.

SUMMARY OF THE INVENTION

In view of the foregoing disadvantages inherent in the known types of ratchet tools now present in the prior art, the present invention provides a new ratchet driver tool that can be utilized for providing convenience for the user when opening or closing the valve post of a gas cylinder in any condition and without requiring the user to visibly see the valve post to engage the tool.

It is therefore an object of the present invention to provide a new and improved ratchet driver tool that has all of the advantages of the prior art and none of the disadvantages.

It is another object of the present invention to provide a ratchet driver tool that comprises a handled portion for single hand use and a specific valve post socket that is specific to gas cylinder valves.

Another object of the present invention is to provide a ratchet driver tool that is one-hand operated and can ratchet in either direction, whereby the user can manually open or close a gas cylinder valve in a ratcheting motion using a single hand.

Yet another object of the present invention is to provide a ratchet driver tool with a socket having a specific shape, whereby the device is adapted to readily engage the valve post of a gas cylinder in low light and emergency situations, wherein visibility is limited and the gas is urgently required.

Another object of the present invention is to provide a ratchet driver tool that has a handle adapted for placement in the palm of the hand and a ratchet switching actuator that can be articulated with the same hand.

Another object of the present invention is to provide a ratchet driver tool that discloses a compact and novel ratcheting mechanism, wherein a socket gear is ratchetably controlled via a pair of wedge plates controlled by a flat spring beneath an ratchet direction actuator in the tool handle.

A final object of the present invention is to provide a ratchet driver tool that may be readily fabricated from materials that permit relative economy and that are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
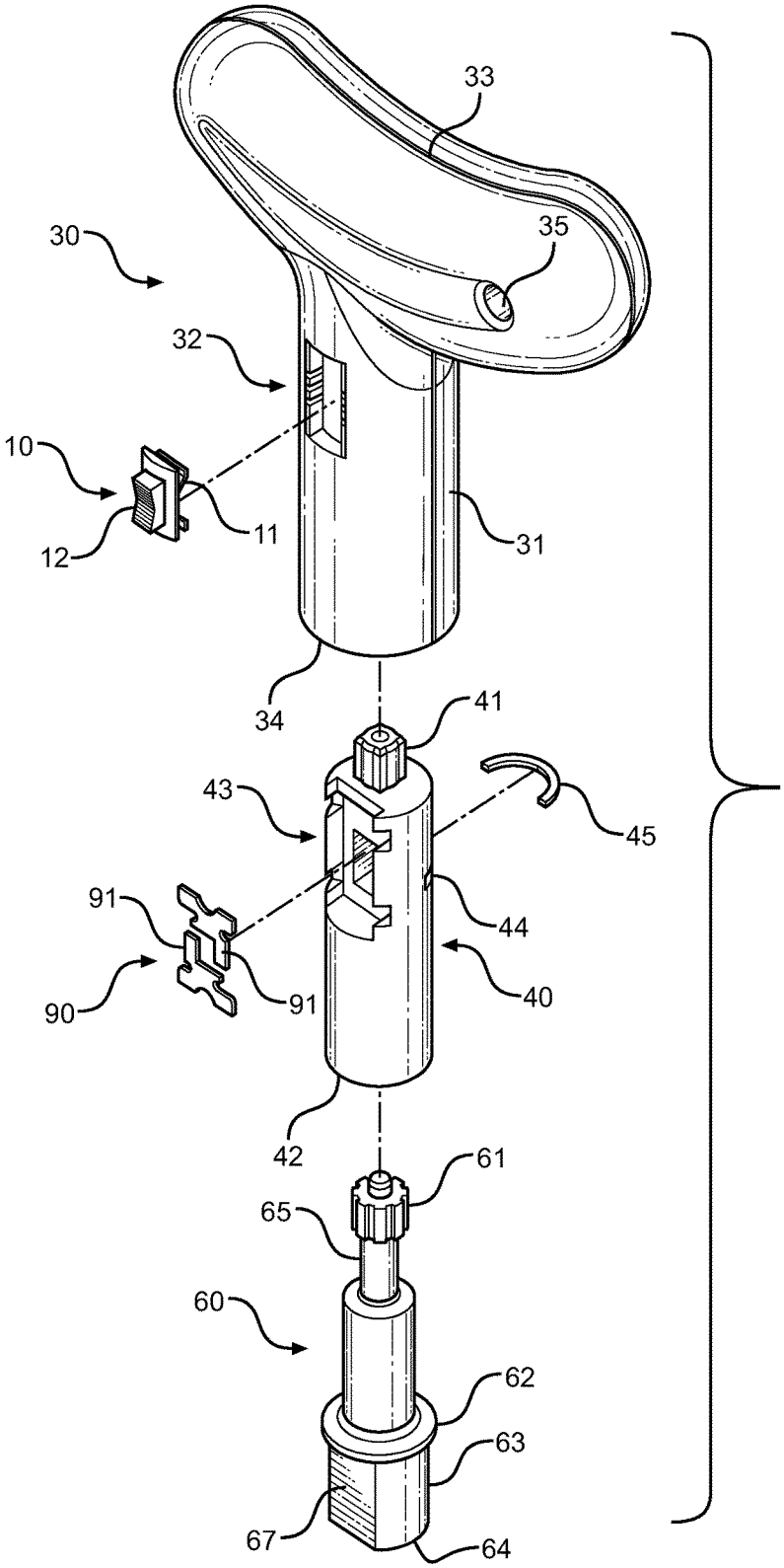
FIG. 1 shows an exploded view of the ratchet driver tool of the present invention.

Reference is made herein to the attached drawings. Like reference numerals are used throughout the drawings to depict like or similar elements of the ratchet driver tool of the present invention. For the purposes of presenting a brief and clear description of the present invention, the preferred embodiment will be discussed as used for providing a handheld, palm driven ratchet tool specifically suited for opening and closing gas cylinder valve posts. The figures are intended for representative purposes only and should not be considered to be limiting in any respect.

Referring now to FIG. 1, there is shown an exploded view of the ratchet driver tool of the present invention. The tool comprises a handheld device that allows a user to apply torque to a valve post of a gas cylinder valve with the use of one hand, and further facilitates locating the valve post in low light and emergency situations. The tool comprises a tool handle 30 that houses the working elements of the tool and provides a handle grip for the user to apply torque thereto. The handle 30 comprises a handle body portion 31 and a handle grip portion, wherein the two are disposed in a substantially perpendicular relationship to one another and form a substantial T-shaped grip.

The handle 30 comprises an opening interior, wherein the body portion 31 supports the working elements of the ratchet mechanism and accept the same through an open lower surface 34. Preferably the handle is formed from two halves and secured together along a line of connection 33, whereby the two halves may be plastically welded together or similar fastened to one another such that the handle halves remain secured over the lifetime of the tool. Alternative embodiments contemplate handle halves that are separable for maintenance of the tool and for replacing components therein.

Further provided on the tool hand 30 is an actuator aperture 32, which is disposed along the body portion 31 of the handle and provides a location in which a ratchet actuator 10 is seated. The actuator aperture 32 comprises an elongated slot having upper and lower edges, and a pair of side edges. The side edges of the aperture 32 comprise detents or notches that allow the actuator to nestle into a defined position—that position defining the ratchet direction or ratchet lock. Finally, the tool handle 30 comprises a through-hole aperture 35 located along the grip portion. The through-hole aperture 35 allows a user to feed a tether or strap therethrough such that the tool can be supported on the user's person via the tether and the user does not have to physically hold the tool at all times.

Disposed within the tool handle 30, the present invention further comprises the aforementioned ratchet actuator 10, an internal housing 40, ratchet locking wedges 90, and a ratchet socket 60. The internal housing 40 comprises a hollow member that accepts the ratchet socket 60 therein after the socket 60 is positioned through its open lower surface 42. The ratchet sock 60 comprises a socket working end 63 and a ratchet gear 61 upper end, whereby the upper end is positioned within the internal housing 40 and controlled via the ratchet wedge plates 90 and the actuator 10. A housing window 43 is provided through the internal housing 40 such that the gear teeth of the ratchet gear 61 are positioned through the window for the wedges 90 to bear thereagainst and thereby operably limit the rotation of the gear 61 and thus limit the rotation of the socket working end 63.

The ratchet socket 60 comprises an elongated body portion, the ratchet gear upper end 61, a gear stem portion 65, a flange 62, and a socket working end 63. The ratchet socket 60 is a member that is adapted to fit within the internal housing of the tool and be freely rotatable therein and rotatably supported within the housing. The flange 62 is disposed adjacent to the working end 63, while the gear stem portion 65 is adjacent to the gear upper end 61. The socket working end 63 comprises an open lower surface 64 having a defined socket shape that is specifically adapted to be complimentary to a gas cylinder valve post. In this way, the tool is specific to use with gas cylinders and their valve post design, whereby the present invention contemplates the socket is not replaceable and is a permanent fixture in the assembly. Alternate embodiments contemplate a removable socket working end for fitment of different style socket working ends 63.

The socket working end 63 comprises a rounded outer profile and a pair of flat surfaces 67 oppositely disposed from one another along the periphery of the working end 63. The flat surfaces 67 correspond with the flat portions of the socket lower surface 64. This allows the user to recognize the orientation of the socket working end 63 without visualizing it and facilitates positioning of the working end 63 over a gas cylinder valve post. Therefore, the tool can be applied to a valve post without visualizing either the tool or the valve post, and further facilitates efficiency of connection under normal conditions.

The internal housing 40 of the present invention is positioned in the body portion 31 of the handle 30 and is captive therein. Once positioned, the housing 40 remains static in relation to the handle 30 and does not rotate therein. A uniquely shaped head portion 41 is disposed along the top of the housing 40, which is accepted in a complimentary recess within the interior of the handle 30, thereby preventing any rotation of the housing 40 once the two are engaged. The ratchet wedges 90, each having a wedge tab 91 to lock the ratchet gear in a given direction, are positioned within the housing window 43. Along the backside of the housing 40 and oppositely disposed with respect to the housing window 43 is an elongated slot 44. The slot 44 accepts a locking clip 45 that is positioned within the housing 40 and adapted to surround the gear stem portion 65 of the socket 60, thereby locking the socket gear 61 within the housing while also allowing relative rotation therebetween. This positions the gear 61 in the housing window 43 and prevents the two from separating after the locking clip 45 has been installed.

Finally, the actuator 10 is disposed within the elongated actuator aperture 32 of the handle 30. The actuator 10 is a user switch that slides within the slot that is the actuator aperture 32, whereby its position will dictate the ratchet direction of the socket 60 or lock the socket in non-ratcheting, locked state. The actuator includes a finger slide 12 along the exterior surface thereof and a flat spring 11 disposed along the base. The flat spring 11 bears against the wedge plates 90 such that they interfere with the rotation of the ratchet gear 61 in a given direction or provide clearance for the ratchet gear in a given direction. In this way, the device allows the socket 60 and handle 30 to rotate relative to one another in one direction only, or in neither direction (e.g. locked together in a static state). The user dictates this state based on the position of the actuator 10 within the aperture 32 and sliding it to the desired detent position therein.

Figure 2A:
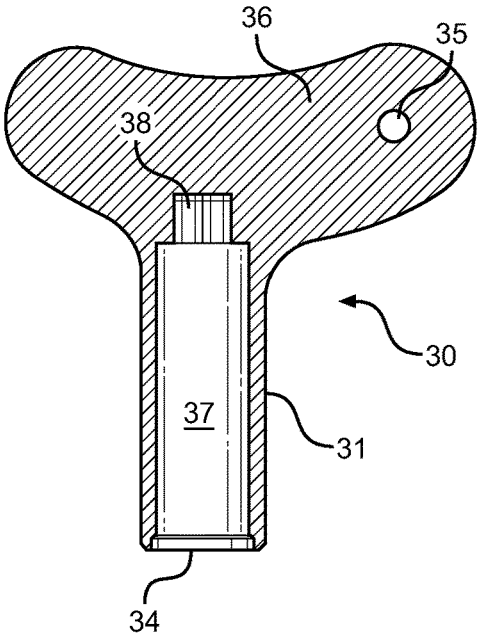
FIG. 2A shows a cross sectional view of the tool handle.
Figure 2B:
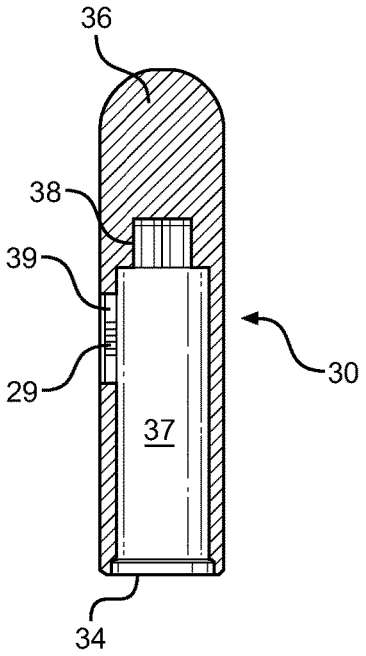
FIG. 2B shows a cross sectional view from the side of the handle.
Figure 2C:
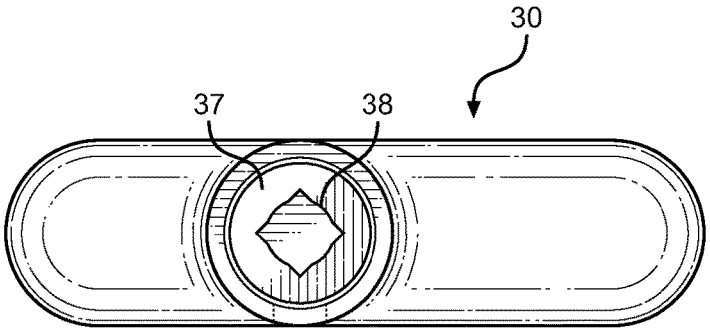
FIG. 2C shows an underside view of the tool handle.

Referring now to FIGS. 2A through 2C, there are shown several views of the handle 30 of the ratchet driver tool of the present invention. As shown the handle comprises an open interior volume 37 along the body portion 31 thereof. The internal volume 37 accepts the internal housing therein and statically supports the housing while engaged. The open interior volume 37 extends from the open lower surface 34 of the body portion 31 to the grip portion 36 of the handle, wherein it terminates in a uniquely shaped recess 38, which is designed to complement and exterior profile of the head portion of the housing. When the two are engaged, the head of the housing nests within the recess 38, whereby the recess includes an open interior and a profile that matches the head portion with a given tolerance fitment. The recess 38 therefore prevents the head from rotating, and therefore prevents the housing from rotating with the handle interior volume 37. The shape of the recess 38 is such that it ensures the housing window is positioned in alignment with the actuator aperture 39 of the grip and that the two will not rotate relative to one another.

Figure 3A:
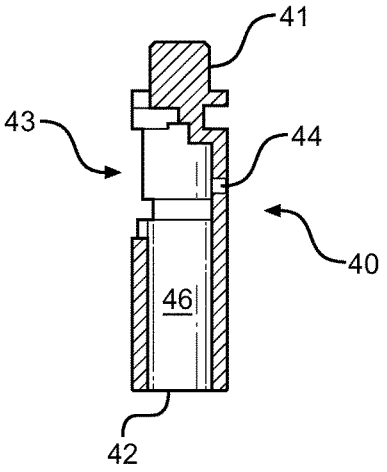
FIG. 3A shows a cross sectional side view of the internal housing.
Figure 3B:
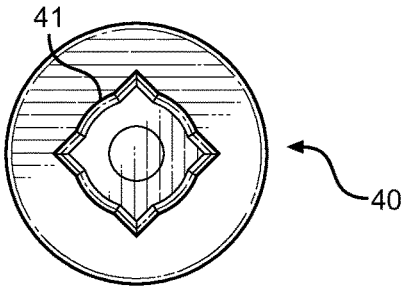
FIG. 3B shows an overhead view of the internal housing.

Referring now to FIGS. 3A and 3B, there are shown views of the internal housing 40 of the present invention. The housing comprises an elongated, tubular member having an opening interior 46, sidewalls, an upper portion and a window 43 adapted to support the actuator and the wedge plates. The wedge plates nest within the outlines of the window 43, whereby the wedges can be pivoted away from the window 43 when the flat spring of the actuator presses against them. Along the sidewall and opposite of the window 43 is a slot 44 for positioning the socket locking clip. The housing interior 46 is sized to support the ratchet socket therein and allow for rotation along its centerline, wherein the locking clip secures the socket within the housing by locking the ratchet gear within the housing interior 46 adjacent to the window 43 portion. The upper portion of the housing comprises a uniquely-shaped head 41 that corresponds to the recess 38 within the handle, whereby the head 41 and recess 38 restrain rotation of the housing 40 within the handle.

Figure 4A:
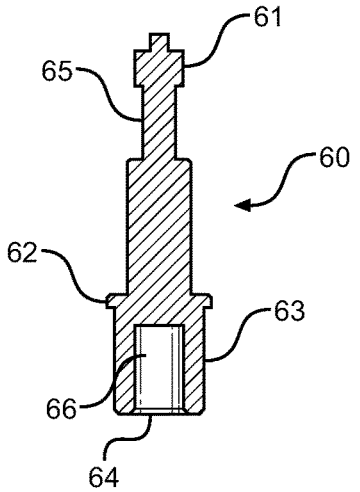
FIG. 4A show a cross sectional view of the socket.
Figure 4B:
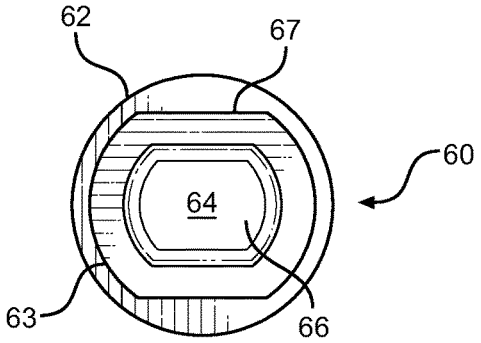
FIG. 4B shows an underside view of the socket.

Referring now to FIGS. 4A and 4B, there are shown views of the socket member 60 of the present invention. The socket comprises an elongated length with a lower socket working end 63 and a ratchet gear upper end 61. Between the working end 63 and the ratchet gear 61 is a gear stem portion 65, an elongated body region and a flange 62. The flange 62 is disposed just above the socket end 63 and is adapted to abut the open lower surface of the handle. The socket end 63 comprises an open lower surface 64 and an open socket interior 66 that is designed to complement a gas cylinder valve post and engage therewith. The walls of the socket comprise a rounded outer profile with a pair oppositely disposed of flat surfaces 67. The flat surfaces 67 correspond with the flat portions of the socket interior 66 as previously described. This allows the user to feel the orientation of the socket without having to visualize it, as it is not a circular aperture and is therefore dependent on correct orientation to secure to the valve post. In an alternate embodiment of the ratchet socket member 60, the socket working end 63 is removable to allow for different socket sizes and types to be secured to the tool. The preferred embodiment contemplates a non-removable socket member that comprises a unitary socket working end, body portion, and ratchet gear upper end.

The ratchet gear 61 of the socket member 60 comprises a gear having a plurality of gear teeth adapted to provide a surface upon which the tabs of the ratchet wedges can bear against to control the ratchet direction. The socket member 60 rotates freely within the internal housing and is stopped from rotating by way of the wedge tabs bearing against the gear 61. In this way, the wedges prevent rotation in one or both directions such that the user can apply torque to the handle and transfer that torque into the socket member 60 and to a valve stem secured to the working end 63 thereof. The direction of free rotation allows the user to freely ratchet back to an original position and then proceed to apply more torque to the valve stem. This ratchet motion is well understood in the art in the art of driver tools and ratchet wrenches.

Figure 5:
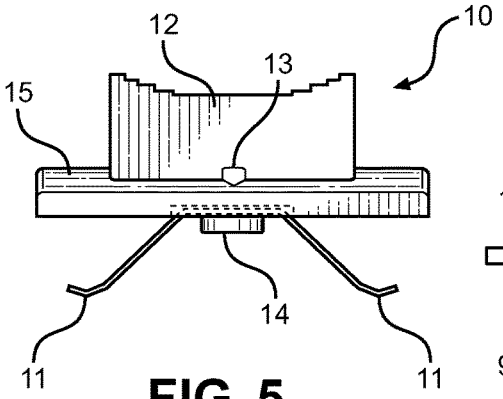
FIG. 5 shows a side view of the ratchet direction actuator switch.
Figure 6:
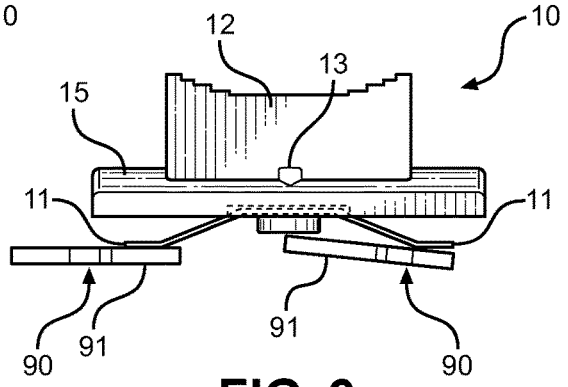
FIG. 6 shows a view of the actuator switch in a working state, orienting the ratchet direction wedges within the device to control the ratchet direction of the socket.
Figure 7:
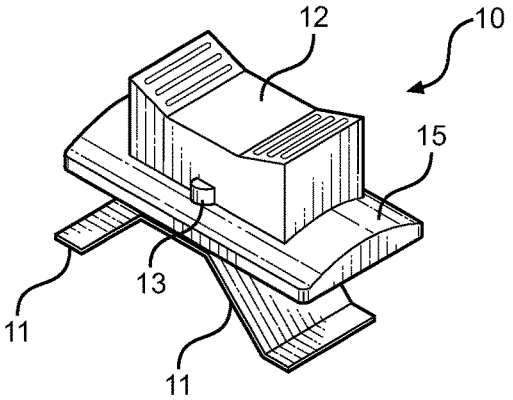
FIG. 7 shows a perspective view of the actuator.
Figure 8:
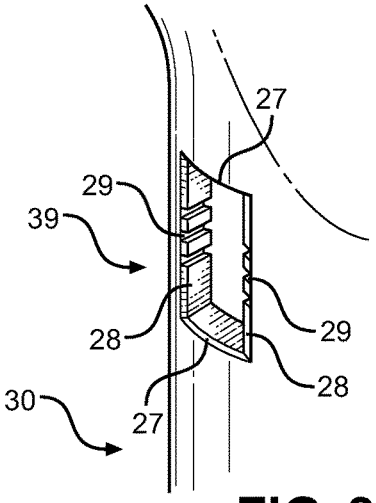
FIG. 8 shows a close-up view of the actuator aperture in the handle body and the edge detents that lock the actuator in one of three positions, which correlate to the desired ratchet direction of the socket.

Referring now to FIGS. 5 and 6, there are shown views of the ratchet actuator 10 and its action on the wedge plates 90 of the present tool. The actuator 10 is a finger movable member having a finger slide outer portion 12, a base surface 15 adjacent thereto and a flat spring 11 fastened to the base surface 15. The flat spring 11 comprises a first and second flange, wherein the wings are adapted to bear against the wedge plates 90 and either secure them in a static state or pivot them upwards and out of the way of the socket gear.

In their static state, the wedge plates 90 are aligned and in the same plane as one another, whereby the wedge tab 91 of each wedge plate 90 interferers with the rotation of the socket gear to prevent its free rotation. To allow the socket gear to rotate freely in one direction (and thus allow ratcheting motion in that direction), the actuator 10 is moved from a central potion within the actuator aperture to one of two outer positions. This positions the flat spring 11 such that one wing bears downward on one wedge plate 90, while the other acts against the end of the opposite wedge plate 90 to pivot its wedge tab 91 upwards and out of the path of the socket gear. This allows the gear to rotate freely in one direction and catch the tab 91 of the opposite wedge plate, allowing torque to be applied in only one direction. When the actuator 10 is in its center position, the wings of the flat spring 11 bear on both wedges 90 equally such that the socket gear cannot rotate freely in either rotational direction. This is the locked position that does not allow ratcheting action. The flat spring 11 is fastened to the actuator 90 via a fastener 14, and the wings of the flat spring 11 are biased downwards such that they apply pressure to the wedge plates 90 when the actuator 10 is positioned within the actuator aperture.

Referring now to FIGS. 5 through 8, the actuator 10 and the actuator aperture 39 are shown. The actuator 10 slides within the actuator aperture 32 and is positioned in one of three locations therein. Along the sides of the finger slide outer portion 12 are actuator tabs 13. These tabs are adapted to be positioned and held captive in one of three notches 29 along the lateral sidewalls 28 of the actuator aperture 39. These notches 29 for detents, whereby the actuator will remain stationary and in the chosen location without freely moving. The user applies pressure to the actuator finger slide 12 to force the tabs 13 out of the notches 29 and thus change the positioning of the actuator 10. This changes the positioning of the flat spring 11 against the wedges, and therefore changes the ratchet action. The actuator 10 slides between the upper and lower ends 27 of the aperture 39, whereby the user can readily manipulate its position along the side of the tool handle 30. The base portion 15 comprises a larger area than the finger slide 12 and is positioned behind the actuator aperture 39 such that the actuator assembly 10 will not fall out of the aperture 39.

Figure 9:
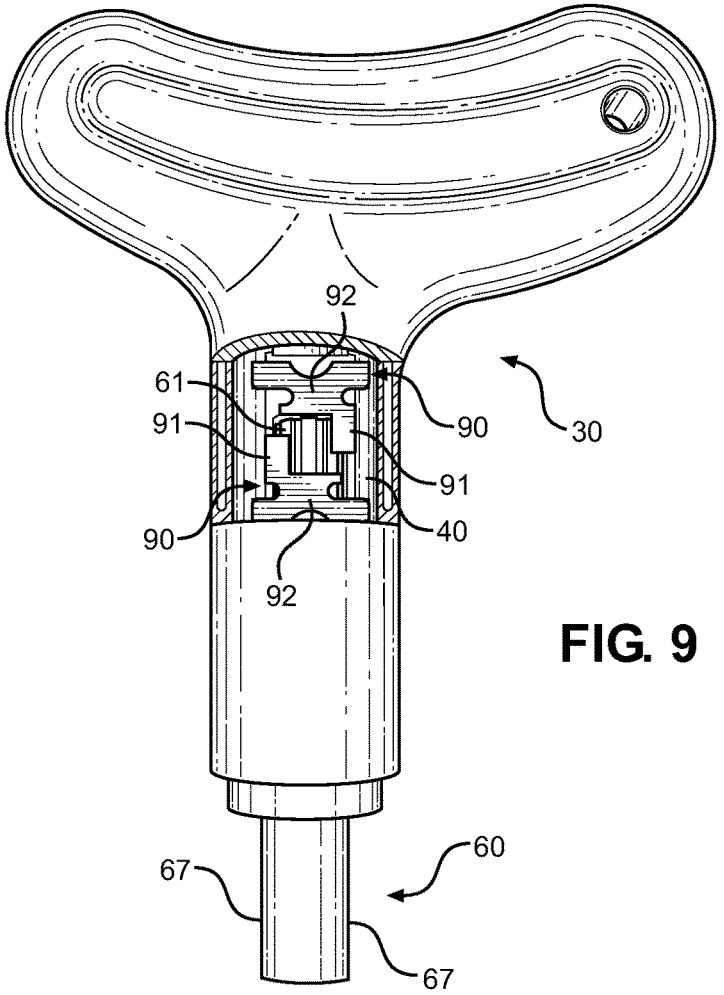
FIG. 9 shows a frontal view of the ratchet driver tool of the present invention with a cut-out, whereby the ratchet direction wedges and their action on the gear end of the socket are shown.

Referring finally to FIG. 9, there is shown a view of the driver tool of the present invention in a constructed state, whereby the tool handle 30 includes a cut-away portion such that the relative positioning of the ratchet wedges 90 and the socket gear 61 are visualized. As previously disclosed, the tabs 91 of the ratchet wedges 90 are positioned such that they engage and interfere with the teeth of the ratchet gear 61. This allows the tabs 91 to catch the gear teeth in one direction and prevent free rotation of the socket gear and the socket working end 60. The flat spring of the actuator bears against the wedges in one of three positions, either applying equal pressure to each wedge (ratchet lock), applying pressure to the backside 92 of the upper wedge (allowing clockwise ratchet/free rotation), or applying pressure to the backside 92 of the lower wedge (allowing counterclockwise ratchet/free rotation). This allows the socket working end 60 to rotate freely in one direction or be statically locked in relation to the handle 30. FIG. 9 furthermore illustrates the flat sides 67 of the socket working end 60. Combined, the flat portions 67 of the socket, its specific design for gas cylinder valves, and the ratchet action of the device facilitate easy access and rapid opening or closing of the gas cylinder valve by the user, whereby the time required to engage the tool and open or close the valve is a fraction of that required by currently available tools in the art.

When oxygen or another vital gas is needed, a person's ability to conveniently open a cylinder quickly and correctly can be a life-saving task. Ratchet wrenches are an easy, user-friendly tool that are highly efficient in their conventional uses; however these devices are not always efficient in emergency situations and situations where application of the tool is hindered by poor environments. The present invention provides a palm-driven driver tool that allows ratcheting motion via wrist pronation and supination, whereby the ratchet direction can be controlled by a single finger and the engagement of the tool socket with a gas cylinder valve stem can be accomplished in nearly any environmental condition. The socket includes a gas cylinder specific design, whereby the socket includes an oval shape with flat sizes that can be quickly placed on top of valve stem with extreme accuracy and efficiency to apply torque thereto. This allows medical staff, emergency responders, and those in industry to rapidly deploy a gas cylinder valve using a driver tool and not resorting to larger open box or crescent wrenches that are awkward to deploy and adversely affect time sensitive situations.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ratchet driver tool, comprising:

a tool handle comprising a handle grip portion and a handle body portion;

said handle body portion having an open lower surface, an open interior volume and an actuator aperture;

an internal housing sized to fit within said open interior volume of said handle body portion;

said internal housing having an open housing interior, sidewalls having a housing window, an upper portion, and an open lower surface;

a ratchet socket member comprising an elongated body portion, an upper end, a stem portion disposed below said upper end, and a socket working end;

said upper end of said ratchet socket member further comprising a ratchet gear with gear teeth;

said ratchet socket member sized to fit within said internal housing and be rotatably supported therein;

said ratchet gear disposed within said housing window;

a first and second ratchet wedge plate disposed within said housing window of said internal housing, each ratchet wedge plate having a wedge tab adapted to operably engage said ratchet gear and prevent rotation in a given rotational direction;

a ratchet actuator disposed within said actuator aperture, said ratchet actuator being adapted to bear against said first and second ratchet wedge plate such that said socket working end ratchets freely in a clockwise direction, counterclockwise direction, or is locked in both a clockwise and counterclockwise directions;

and said socket working end having a first flat portion and opposing second flat portion to facilitate rapid placement of the said socket working end onto a gas cylinder valve post in emergency or low-light situations.

2. The ratchet driver tool of claim 1, wherein:

said upper portion of said internal housing further comprises a head portion;

said open interior volume of said handle body portion extends from the open lower surface of the body portion and terminates therein at a recess;

said head portion and said recess being complimentary, wherein said head portion is sized to fit within said recess;

said recess adapted to prevent rotation of said head portion when engaged.

3. The ratchet driver tool of claim 1, wherein:

said internal housing further comprises a sidewall having a slot disposed therealong;

said slot adapted to accept a locking clip therethrough;

said locking clip being adapted to surround said stem portion of said ratchet socket member and prevent separation of said internal housing and said ratchet socket member.

4. The ratchet driver tool of claim 1, wherein:

said ratchet actuator further comprises a finger slide portion, a base surface, and a flat spring secured to said base surface;

said flat spring having a first and second wing being biased away from said base surface;

said first and second wing adapted to bear against said first and second ratchet wedge plates.

5. The ratchet driver tool of claim 1, wherein:

said ratchet actuator further comprises a finger slide portion, a base surface, and a flat spring secured to said base surface;

said flat spring having a first and second wing being biased away from said base surface;

said first and second wing adapted to bear against said first and second ratchet wedge plates;

said first and second ratchet wedge plates each comprising a wedge flange and a backside;

one of said first and second wings operably bearing against said backside of one of said first and second ratchet wedge plates and affect a pivoted condition;

said pivoted condition of one of said first and second ratchet wedge plate providing clearance for said ratchet gear.

6. The ratchet driver tool of claim 1, wherein:

said ratchet actuator further comprises at least one actuator tab;

said actuator aperture having lateral sidewalls and an upper and lower end;

at least one of said lateral sidewalls having three notches sized to receive one of said at least one actuator tab.

7. The ratchet driver tool of claim 1, wherein:

said socket working end comprises a generally rounded outer profile and a pair of flat surfaces oppositely disposed from one another along said outer profile;

said socket working end further comprising an open lower surface and an open socket interior.

8. The ratchet driver tool of claim 7, wherein:

wherein said open socket interior comprises a generally rounded profile and a first and second flat surface;

said rounded profile and said first and second flat surface of said open socket interior being aligned with said generally rounded outer profile and pair of flat surfaces of said socket working end to facilitate rapid deployment to open or close the valve post of a conventional gas cylinder.

9. The ratchet driver tool of claim 1, wherein:

said handle grip portion and said handle body portion form a tool handle that is substantial T-shaped.

10. The ratchet driver tool of claim 1, wherein:

said handle grip portion further comprises a through-hole aperture.

11. The ratchet driver tool of claim 1, wherein:

tool handle comprises a first and second half that is secured along a line of connection.

12. The ratchet driver tool of claim 1, wherein:

said socket working end is selectively interchangeable from said ratchet socket member.

* * * * *